US005680035A

United States Patent [19]

Haim et al.

[11] Patent Number: 5,680,035

[45] Date of Patent: Oct. 21, 1997

[54] ELECTRONIC FILTER

[76] Inventors: Neerman Haim, 9 Amnon & Tamar Street, Rosh Haayin 48580, Israel; Niv Nehemia, 49 Arlozorov Street, Petach Tikva 49453, Israel

[21] Appl. No.: 611,056

[22] Filed: Mar. 5, 1996

[30] Foreign Application Priority Data

Mar. 7, 1995 [IL] Israel ..... 112928

[51] Int. Cl.[6] ..... G05F 1/573

[52] U.S. Cl. ..... 323/277; 323/275; 323/280; 323/303

[58] Field of Search ..... 323/275, 277, 323/280, 303

[56] References Cited

U.S. PATENT DOCUMENTS 4,327,319 4/1982 Swisher et al. ..... 323/303

4,704,572 11/1987 Melbert ..... 323/275

4,814,687 3/1989 Walker ..... 323/275

5,191,278 3/1993 Carpenter ..... 323/275

*Primary Examiner*—Peter S. Wong

*Assistant Examiner*—Shawn Riley

*Attorney, Agent, or Firm*—Abelman, Frayne & Schwab

[57] ABSTRACT

This invention discloses an active electrical current filter including an N-channel FET controller coupled in series along a positive electrical line between an electrical power input and an electrical power output having voltages within a given range, apparatus for providing a driving voltage to the FET controller, the driving voltage being in excess of the voltages within said given range, and a differential voltage sensor, which senses the difference between the voltages at the filter input and output and whose output governs the driving voltage supplied to the FET controller, the active electrical filter exhibiting a voltage drop of less than one volt.

29 Claims, 10 Drawing Sheets

ELECTRONIC FILTER

FIELD OF THE INVENTION

The present invention relates to electrical filters generally and more particularly to active electrical filters.

BACKGROUND OF THE INVENTION

A great variety of active electrical filters is known in the art. Various active voltage filters and voltage regulators are commercially available for power supply applications. Examples of such products are the Models LM7805, LM317 and LM2940 commercially available from National Semiconductor.

Although passive current filters are commercially available, active current filters are not commercially available.

SUMMARY OF THE INVENTION

The present invention seeks to provide improved active electrical filters and voltage regulators.

There is thus provided in accordance with a preferred embodiment of the present invention an active electrical current filter including:

- an N-channel FET controller coupled in series along a positive electrical line between an electrical power input and an electrical power output having voltages within a given range;
- apparatus for providing a driving voltage to the FET controller, the driving voltage being in excess of the voltages within said given range; and
- a differential voltage sensor, which senses the difference between the voltages at the filter input and output and whose output governs the driving voltage supplied to the FET controller,
- the active electrical filter exhibiting a voltage drop of less than one volt.

Alternatively, the driving voltage is less than the voltages within the given range by at least 5 volts and preferably by at least 10 volts.

Preferably the filter also includes a current sensor whose output governs the driving voltage supplied to the FET controller.

Preferably, the apparatus for providing a driving voltage includes a voltage source other than the electrical power input to the FET controller.

Preferably, the voltage source receives electrical power from the electrical power input.

There is also provided in accordance with a preferred embodiment of the present invention an active current filter including:

- a FET controller coupled in series between an electrical power input and an electrical power output having voltages within a given range;
- apparatus for providing a driving voltage to the FET controller, the driving voltage being in excess of the voltages within the given range; and
- a sensor whose output governs the driving voltage supplied to the FET controller.

Preferably the active electrical current filter also includes an additional voltage bias operative to provide a desired voltage drop across the FET controller to provide efficient operation of the filter.

Additionally in accordance with a preferred embodiment of the present invention, the active electrical current filter also includes an AC to DC converter upstream of the FET and a DC to AC converter downstream of the FET.

Preferably, the active electrical current filter also includes a protection circuit connected in parallel with said FET controller, said protection circuit being operative to limit the voltage across the FET controller and to provide inrush current protection thereto.

There is also provided in accordance with a preferred embodiment of the present invention an active AC electrical current filter comprising:

- an AC rectifying bridge arranged in series on an AC line and having positive and negative electrical line outputs carrying voltages within a given range;
- an N-channel FET controller coupled in series across said positive and negative electrical line outputs;
- apparatus for providing a driving voltage to the FET controller, said driving voltage being in excess of the voltages within said given range; and
- a differential voltage sensor, which senses the difference between the voltages at the filter input and output and whose output governs the driving voltage supplied to the FET controller.

BRIEF DESCRIPTION OF THE DRAWINGS

The present invention will be understood and appreciated more fully from the following detailed description, taken in conjunction with the drawings in which.

DETAILED DESCRIPTION OF A PREFERRED EMBODIMENT

Figure 1:
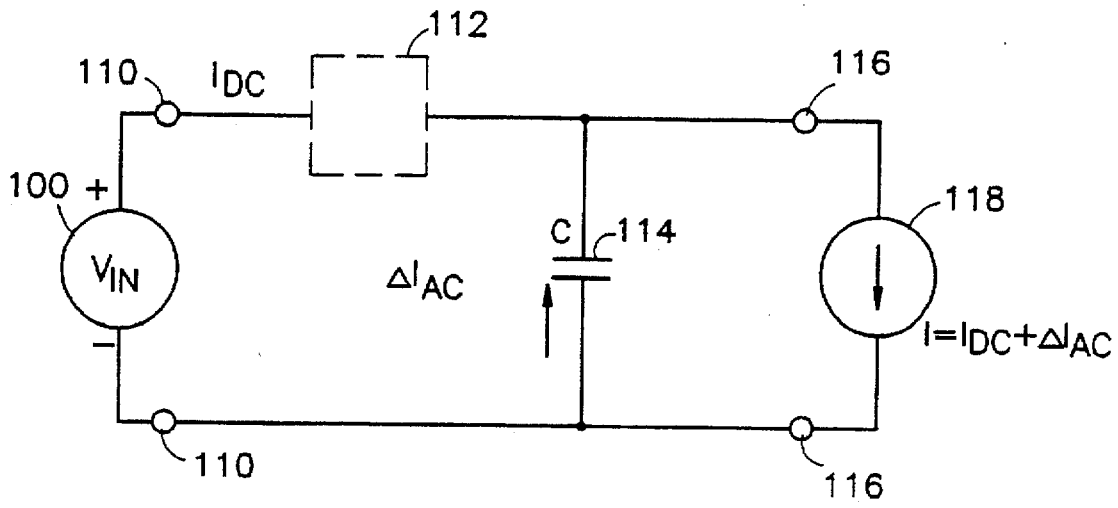
FIG. 1 is a conceptual illustration of an active current filter constructed and operative in accordance with a preferred embodiment of the present invention.

Reference is now made to FIG. 1, which is a conceptual illustration of an active current filter constructed and operative in accordance with a preferred embodiment of the present invention. A DC voltage source 100 is coupled across input terminals 110 of a filter which includes a serial adaptive current source 112 and a parallel connected capacitor 114. The capacitor 114 may be connected across the output terminals 116 as shown or alternatively across the input terminals 110. As a further alternative, separate capacitors 114 may be connected across both the input and output terminals 110 and 116.

A load 118, having both a DC component and an AC component is connected across the output terminals 116.

The embodiment of FIG. 1 illustrates a filter which is operative to effectively attenuate the effect of the AC component of a load having both AC and DC components on a voltage source. This is accomplished by using the capacitor 114 to supply the AC component to the load. The electrical power to the capacitor 114 is provided by the adaptive current source 112, which charges the capacitor.

It is a particular feature of the present invention that the filter operates with a very small voltage drop of the order of tens of millivolts, as compared with voltage drops of one volt or more in the prior art. This advantageous feature is realized by providing a current source 112 which is operative to bias a FET to its most efficient operating point and which has a voltage responsive adaptivity.

It is further appreciated that the filter of FIG. 1 may provide attenuation in the opposite direction, i.e. the effect of changes in voltage at source 100 on the load 118.

Figure 2:
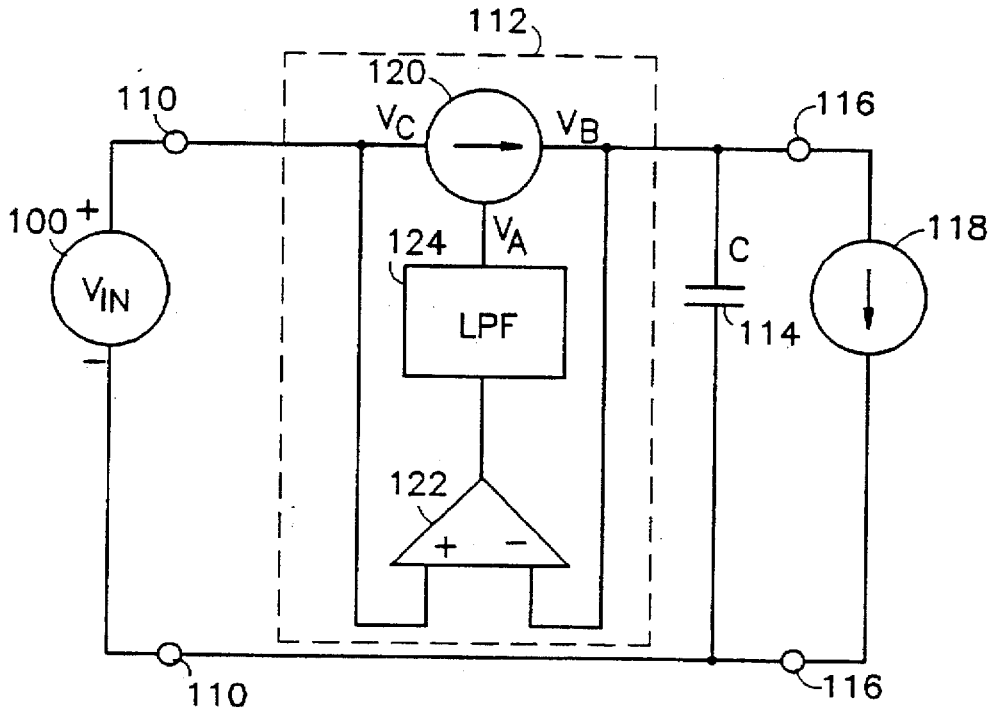
FIG. 2 is a more detailed conceptual illustration corresponding to FIG. 1.

Reference is now made to FIG. 2, which is a more detailed conceptual illustration of the filter of FIG. 1, and which illustrates, in greater detail, the structure of current source 112. It is seen that the current source 112 comprises an ultra-low dropout voltage regulated current source 120 associated with a control circuit including a differential amplifier 122 which outputs via a low pass filter 124 to the voltage regulated current source 120.

It is to be noted that the control is effected by the difference between the voltage VC at the input to current source 120 and the voltage VB at the output of the current source 120. The low pass filter 124 preferably filters the changes in the voltage difference which is used as a reference by current source 120.

Figure 3:
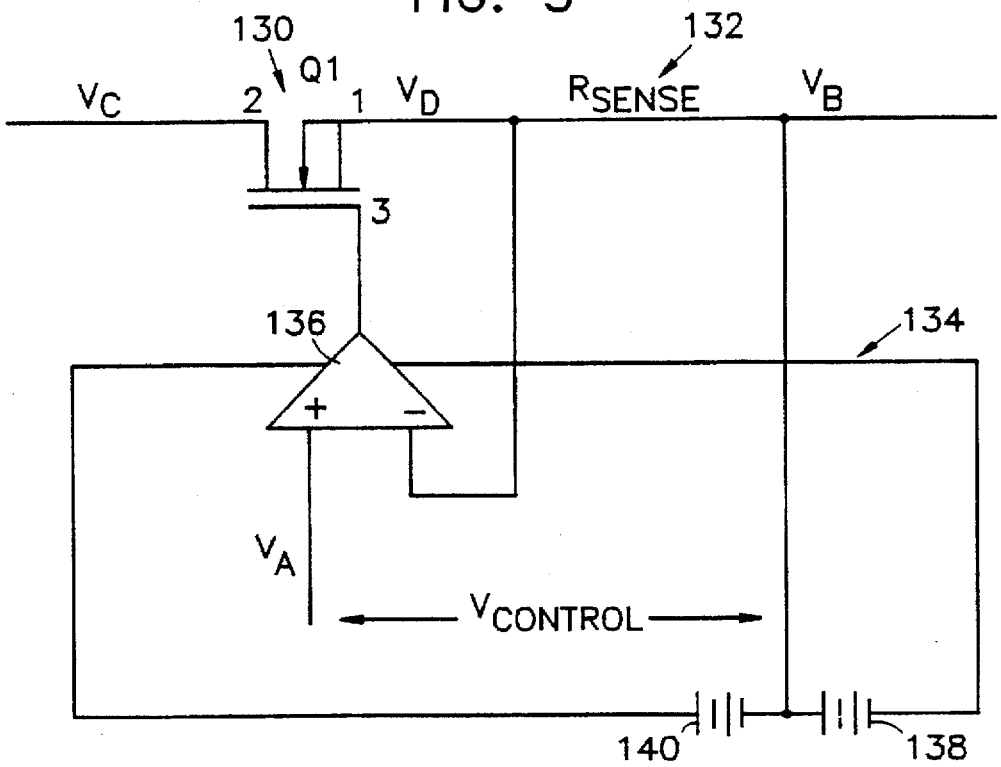
FIG. 3 is a simplified illustration of a current source useful in the apparatus of FIG. 2.

Reference is now made to FIG. 3, which is a simplified illustration of current source 120 employed in the apparatus of FIG. 2. It is seen that current source 120 comprises a FET 130 which operates as a series control of the current passing therethrough. A resistor 132 is provided to permit the voltage drop thereacross to be sampled by a FET bias circuit 134.

The bias circuit 134 comprises a differential amplifier 136 and independent negative and positive voltage sources 138 and 140 which power the differential amplifier. The structure of the bias circuit 134 enables the FET to be completely opened so as to operate with minimal series resistance.

Figure 4A:
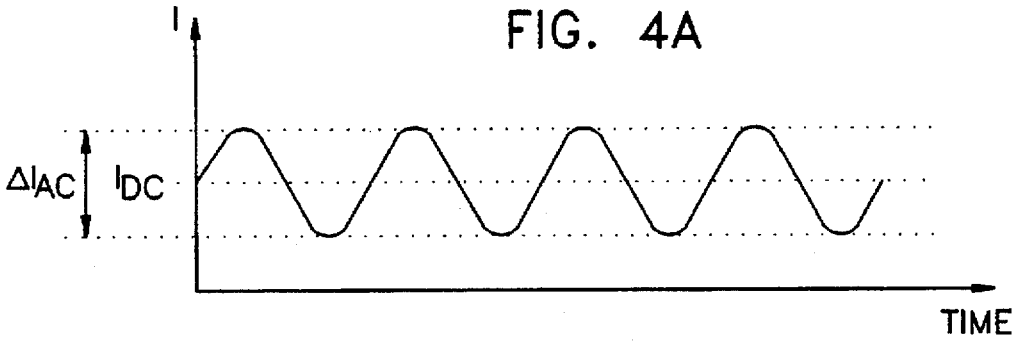
FIGS. 4A and 4B are respectively illustrations of current and voltage at the outputs of the filters of FIGS. 1 and 2.
Figure 4B:
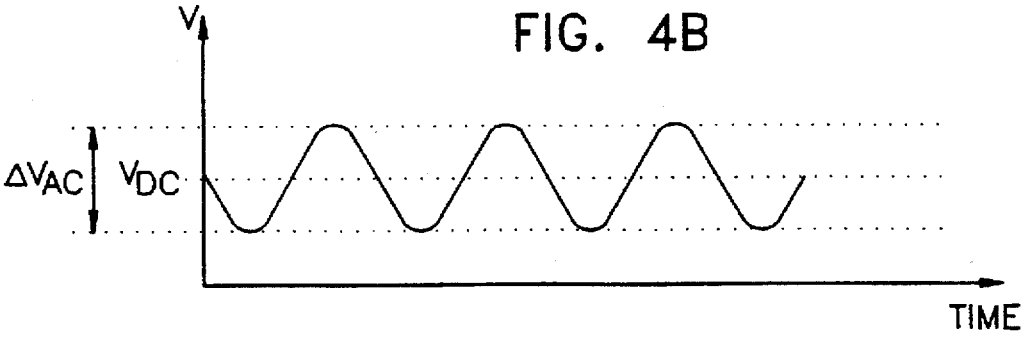

Reference is now made to FIGS. 4A and 4B, which are respectively illustrations of current and voltage at the outputs of the filters of FIGS. 1 and 2. FIG. 4A illustrates time dependent current consumption of the load which includes both AC and DC components. FIG. 4B illustrates the AC and DC voltage drop across the entire filter, represented by the absolute value of VC-VB in FIG. 3. It is appreciated that in accordance with a preferred embodiment of the present invention, the DC voltage drop can be reduced to a very small amount.

Figure 5:
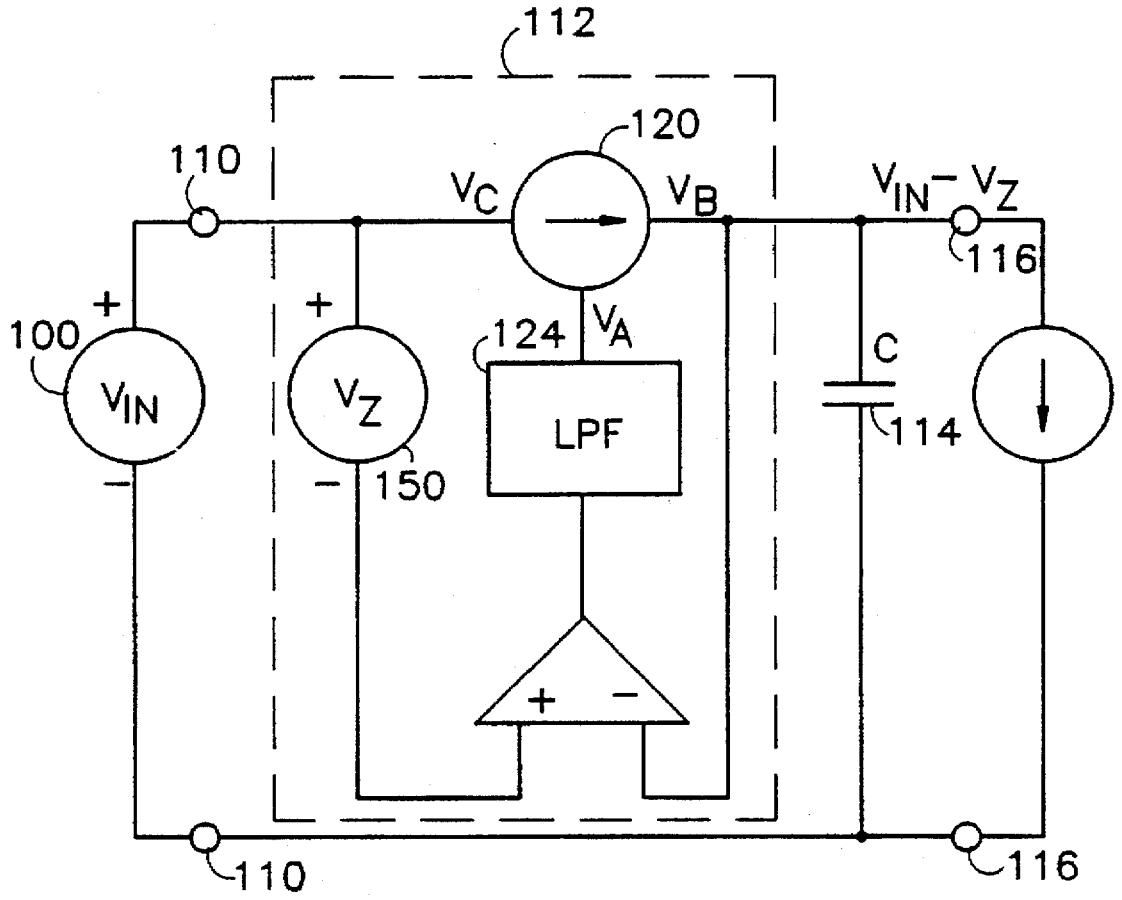
FIG. 5 is an even more detailed conceptual illustration corresponding to FIG. 2.

Reference is now made to FIG. 5, which is an even more detailed conceptual illustration corresponding to FIG. 2. The difference between what is shown in FIG. 2 and in FIG. 5 is that in FIG. 5, an additional voltage source 150 is shown. This voltage source serves to correctly bias current source 120 so as produce a DC bias thereacross which ensures that the DC voltage drop as shown in FIG. 4B cannot fall below zero. It is appreciated that the voltage source 150 is normally present in the embodiment of FIG. 2. It is not illustrated or described therein for reasons of simplicity and clarity of description.

The provision of additional voltage source 150 is a particular feature of the present invention since it ensures that the current source 120 always remains at its optimal point of operation.

Figure 6:
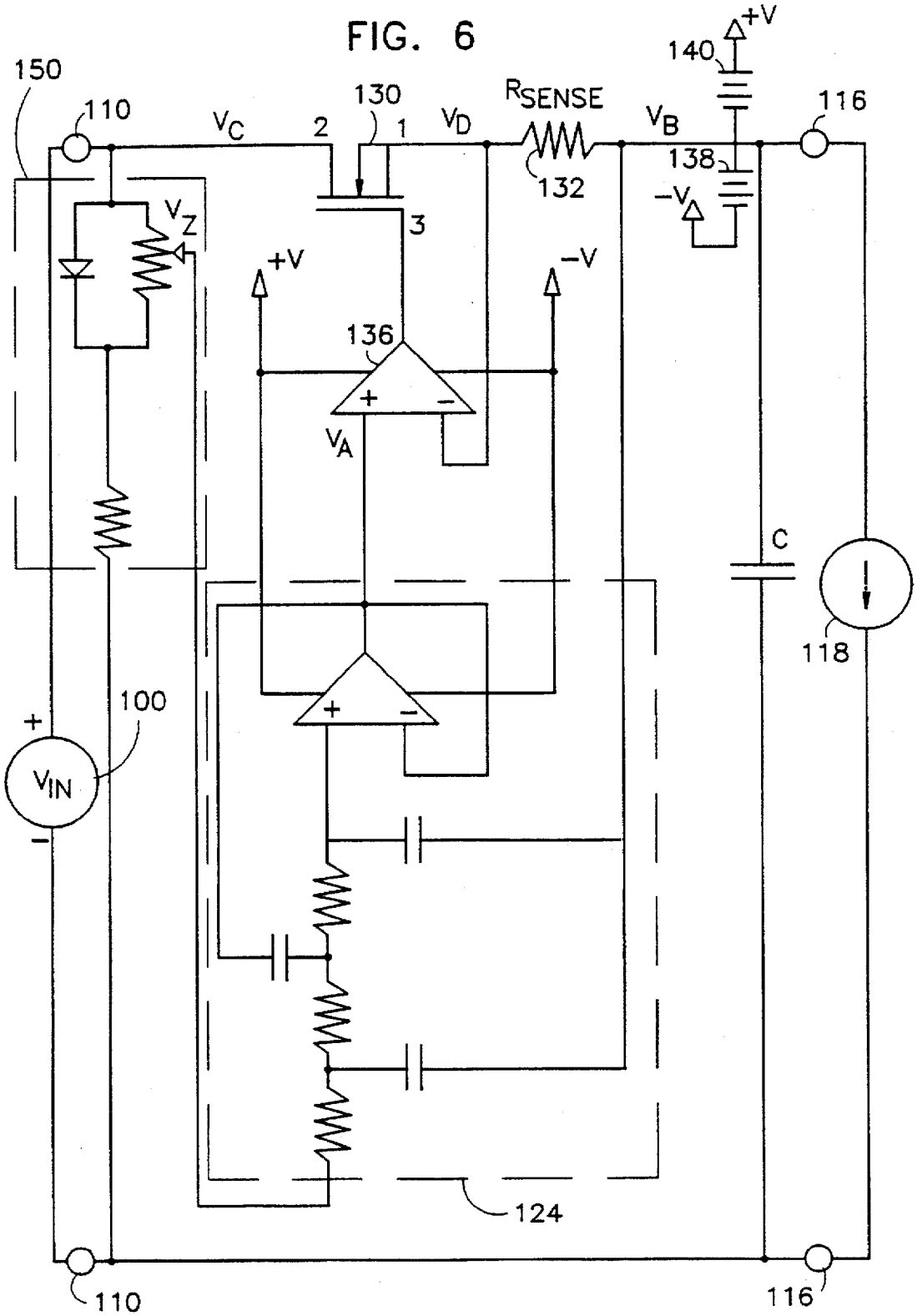
FIG. 6 is a schematic illustration of the apparatus of FIG. 5.

Reference is now made to FIG. 6, which is a schematic illustration of the apparatus of FIG. 5. This figure is believed to be entirely self-explanatory in view of the foregoing description.

Figure 7:
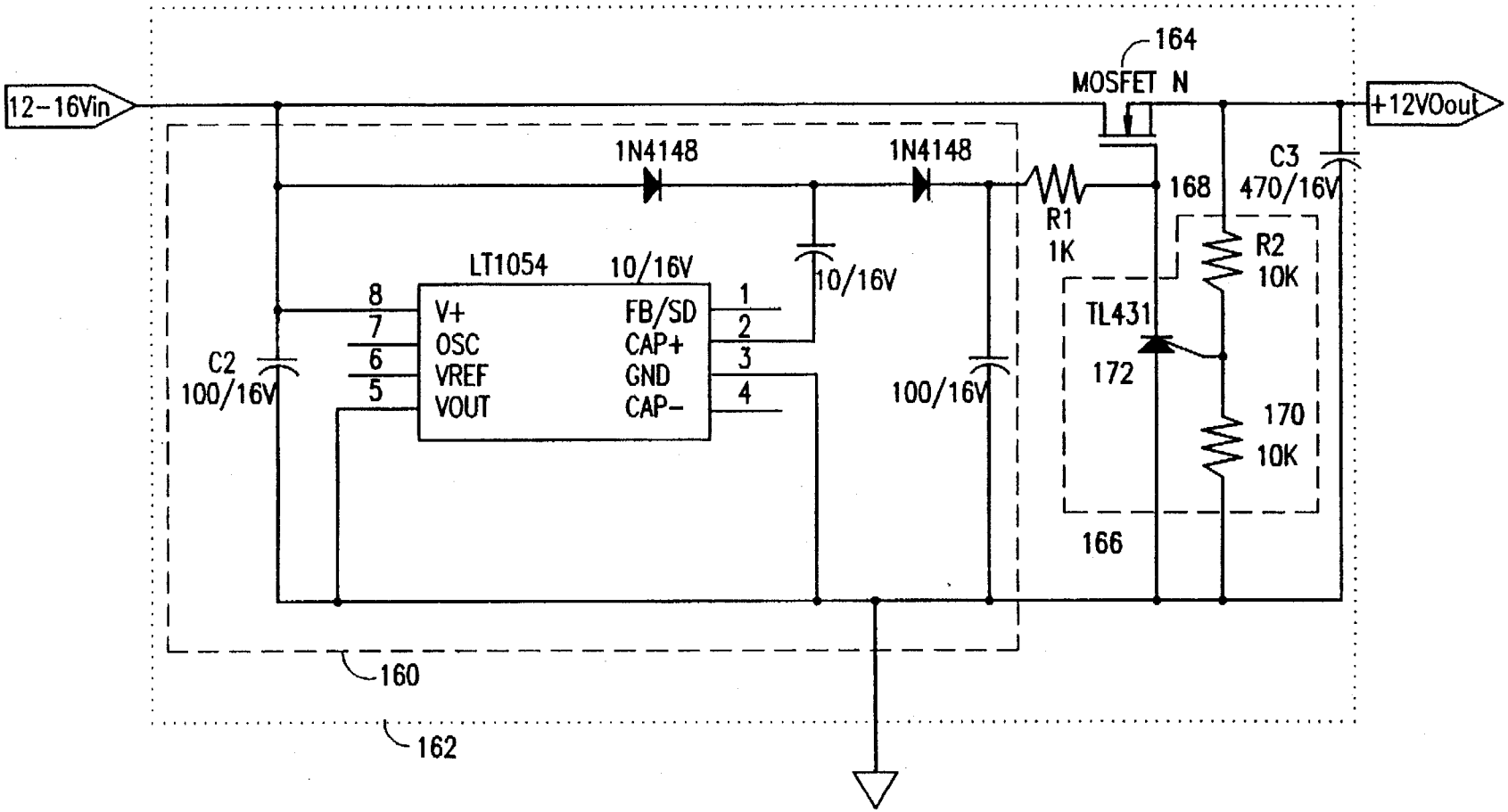
FIG. 7 is a schematic illustration of a voltage regulator and filter constructed and operative in accordance with a preferred embodiment of the present invention.

Reference is now made to FIG. 7, which is a schematic illustration of a voltage regulator and filter constructed and operative in accordance with a preferred embodiment of the present invention. A voltage multiplier 160, typically based a LT1054 voltage doubler chip commercially available from Linear Technology, Inc. of Milpitas, Calif., U.S.A., receives an input voltage from a DC voltage source 162 and provides an output voltage approximately double that of the input voltage to bias a FET 164, whose operation is controlled by a reference and control circuit 166 including resistors 168 and 170 and a controllable voltage reference circuit 172, such as a Motorola TL431.

The structure of the embodiment of FIG. 7 enables it to be embodied in a single monolithic chip and thus enables voltage regulator chips to be provided having a near-zero voltage drop over a wide range of operating currents. Such voltage regulator chips are not presently commercially available.

Figure 8:
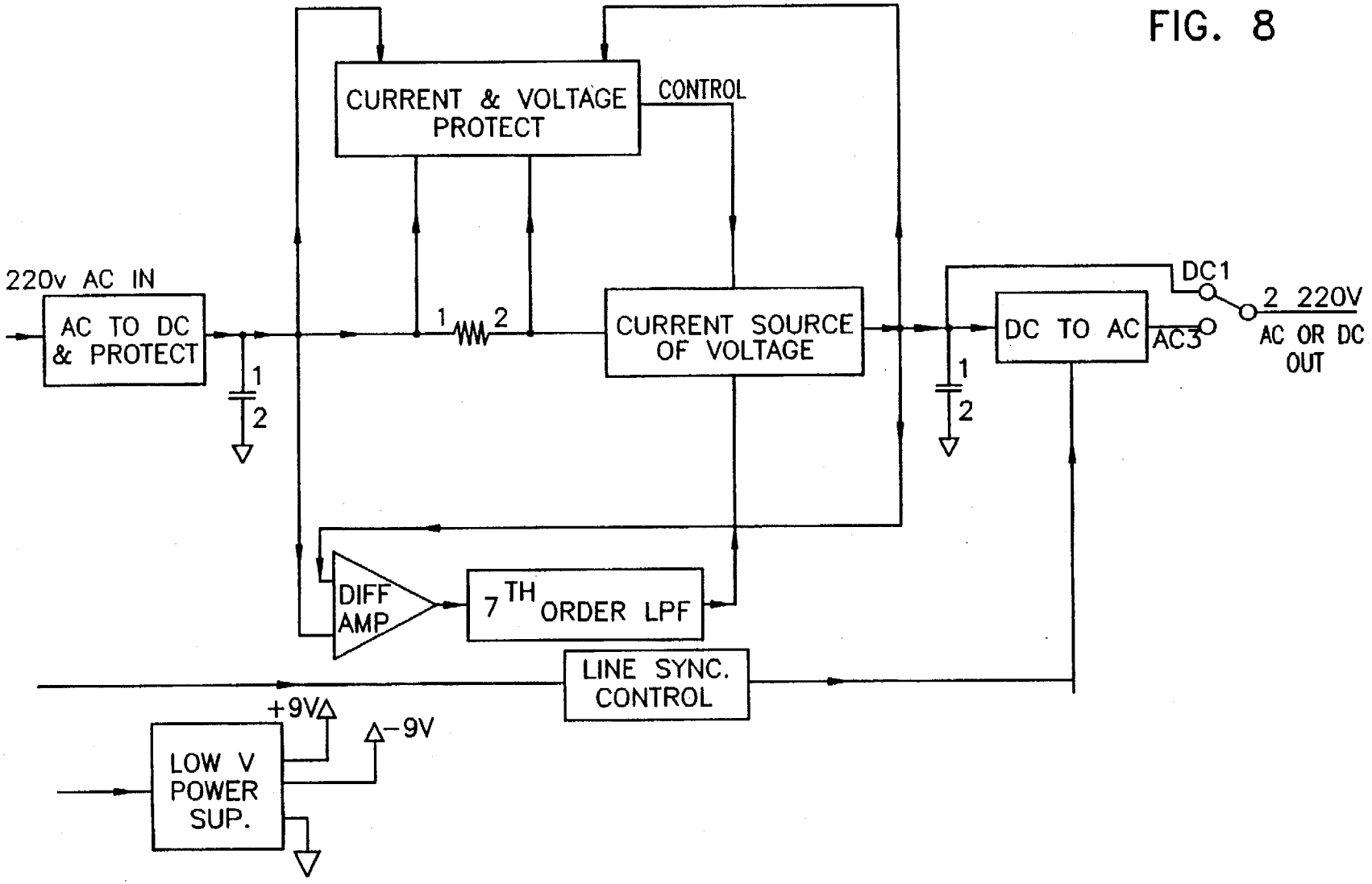
FIG. 8 is a simplified block diagram illustration of an AC current filter constructed and operative in accordance with a preferred embodiment of the present invention.

Reference is now made to FIG. 8, which is a simplified block diagram illustration of an AC current filter constructed and operative in accordance with a preferred embodiment of the present invention. The AC current filter of FIG. 8 is based on a DC current filter 180 which may be identical to current source 112, described hereinabove. Upstream of the DC filter 180 there is provided an AC to DC converter 182 and downstream of the DC filter 180 there is provided a DC to AC converter 184.

Figure 9A:
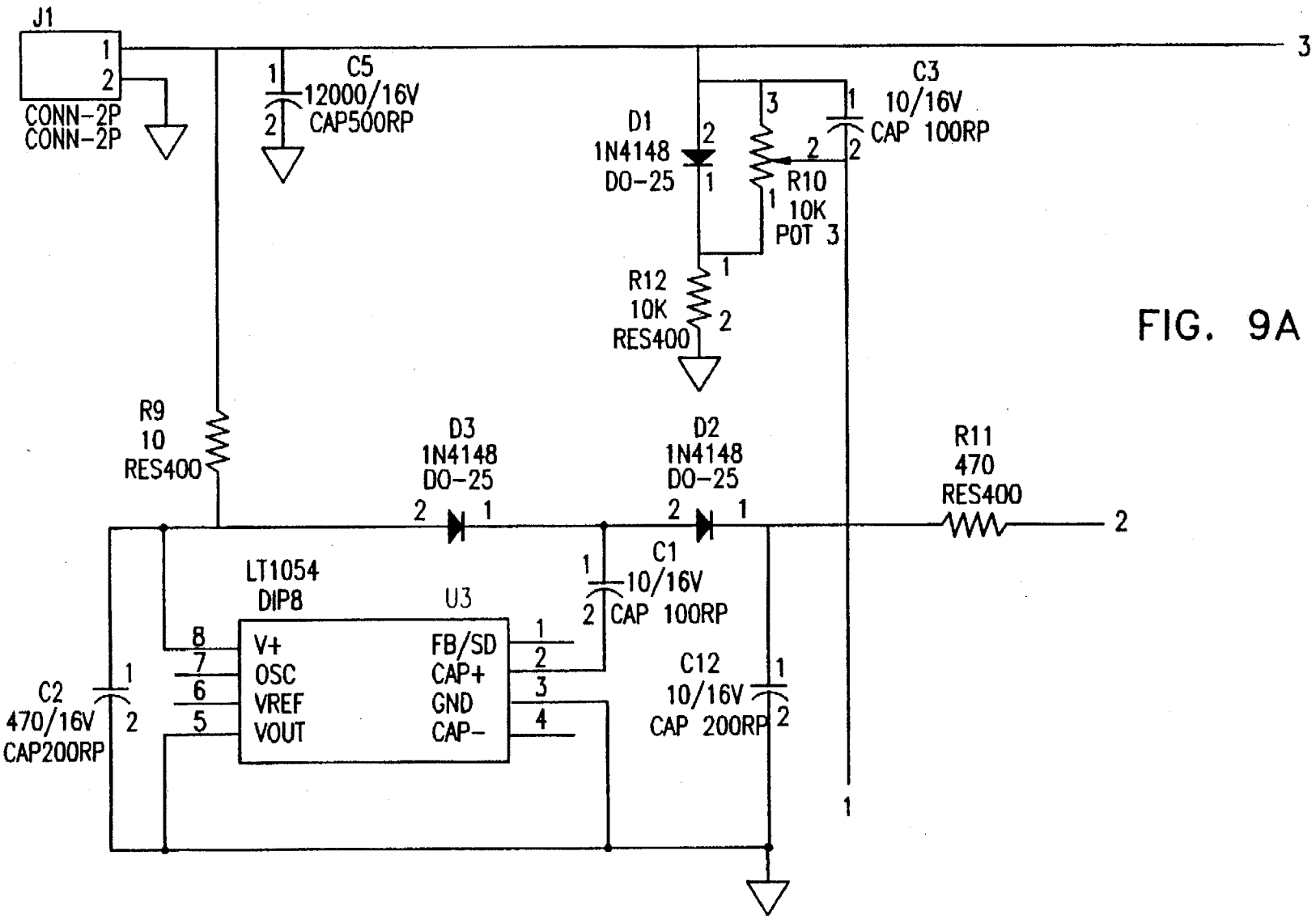
FIGS. 9A, 9B and 9C together constitute a electrical schematic illustration of a DC current filter constructed and operative in accordance with a preferred embodiment of the present invention.
Figure 9B:
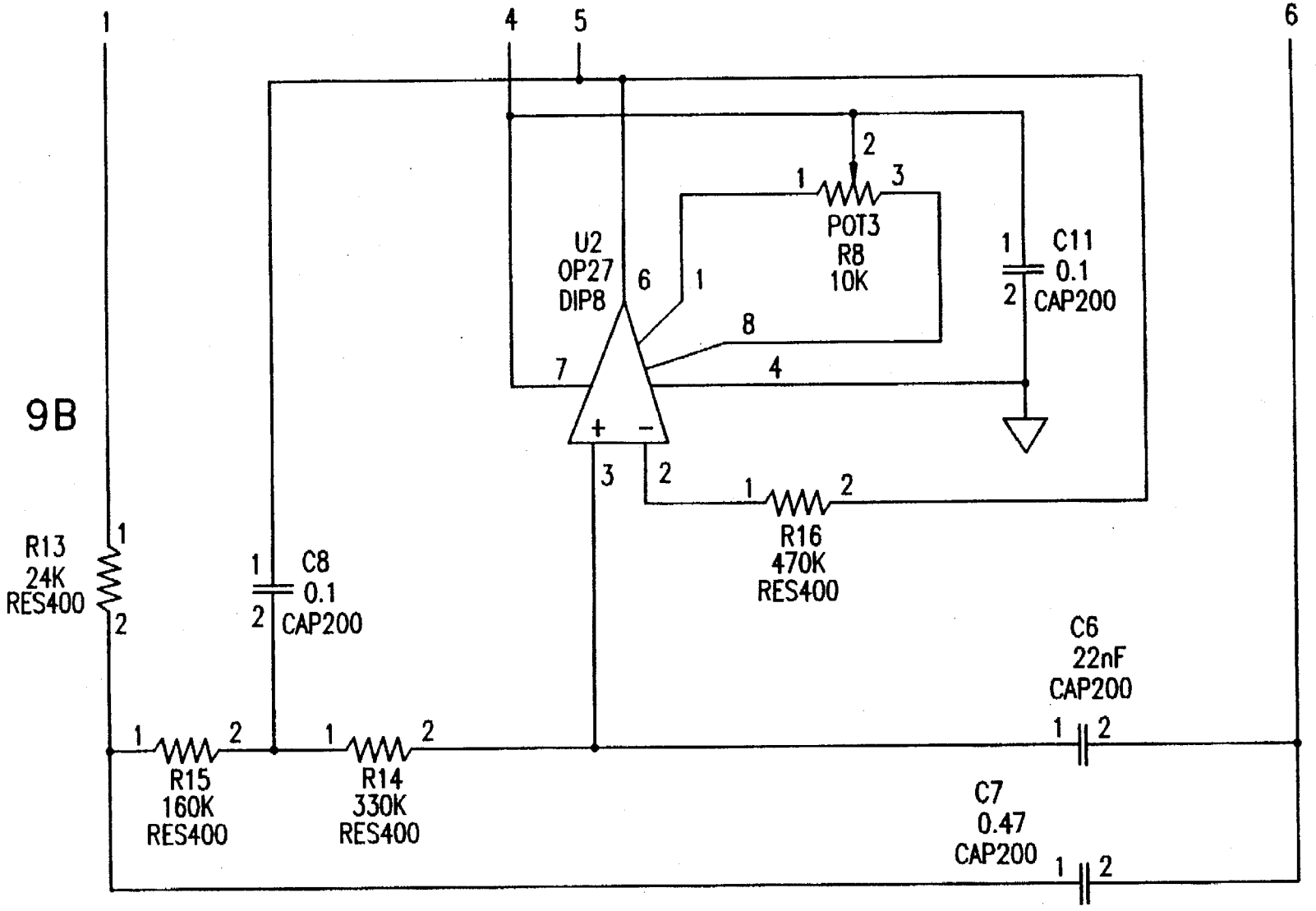
Figure 9C:
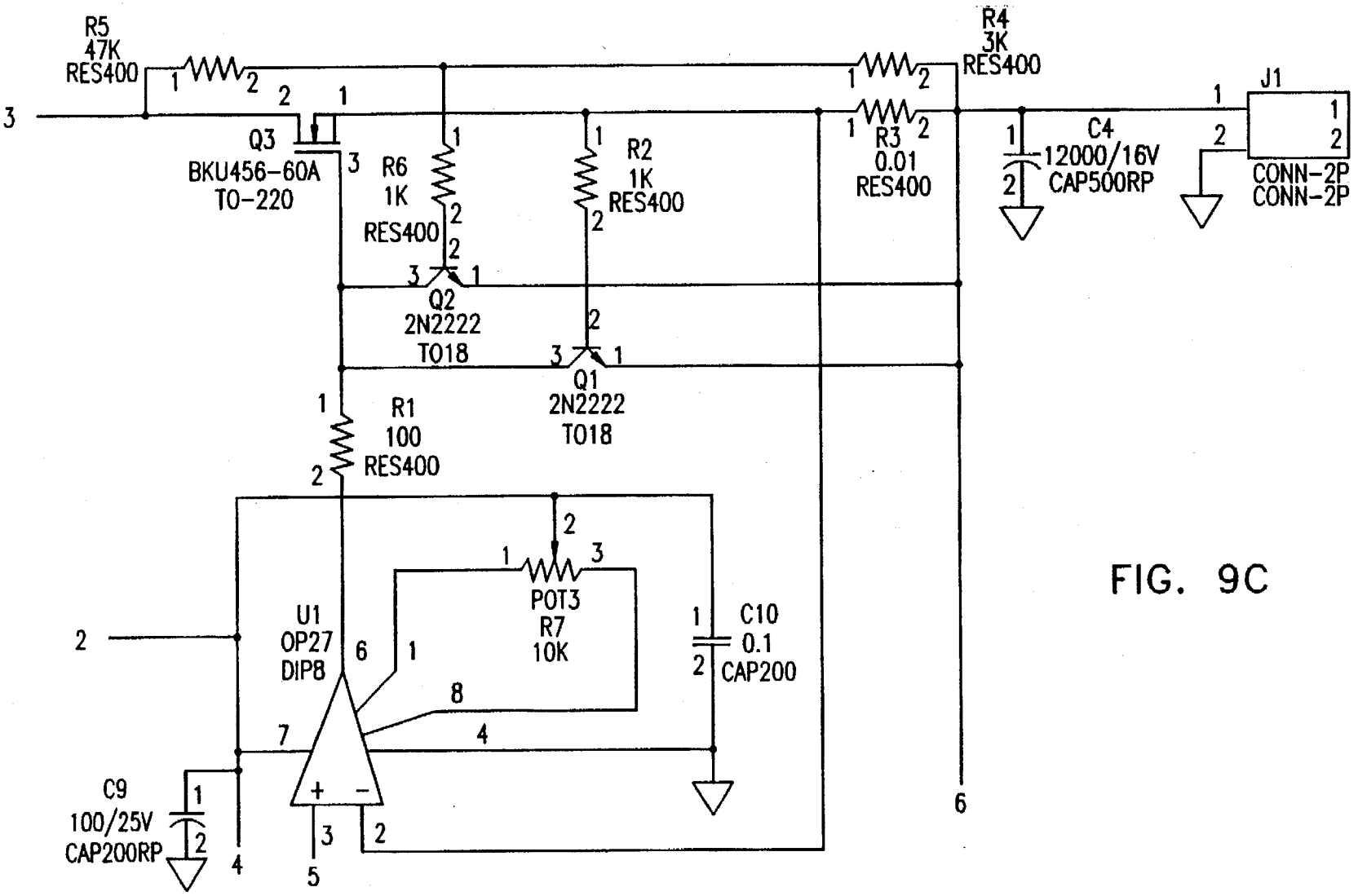

Reference is now made to FIGS. 9A, 9B and 9C, which together constitute a electrical schematic illustration of a DC current filter constructed and operative in accordance with a preferred embodiment of the present invention, which was actually built and tested by applicants. Preferred components and component values are identified in the drawing.

Figure 10:
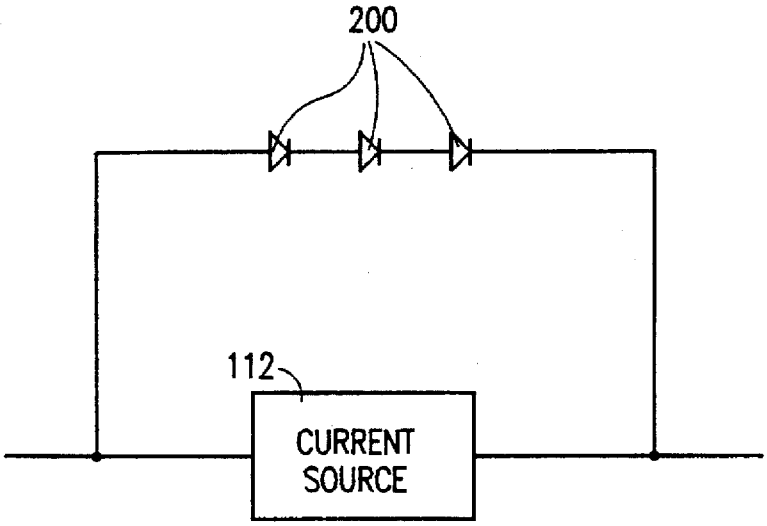
FIG. 10 is a simplified block diagram of a portion of the circuitry of FIG. 2.

Reference is now made to FIG. 10, which illustrates current source 112 (FIG. 2) with the addition of a plurality of diodes 200, typically three in number, which provide inrush current protection to the current source 112. This enables a current source 112 employing low voltage FETs to be used for high voltage applications.

Figure 11:
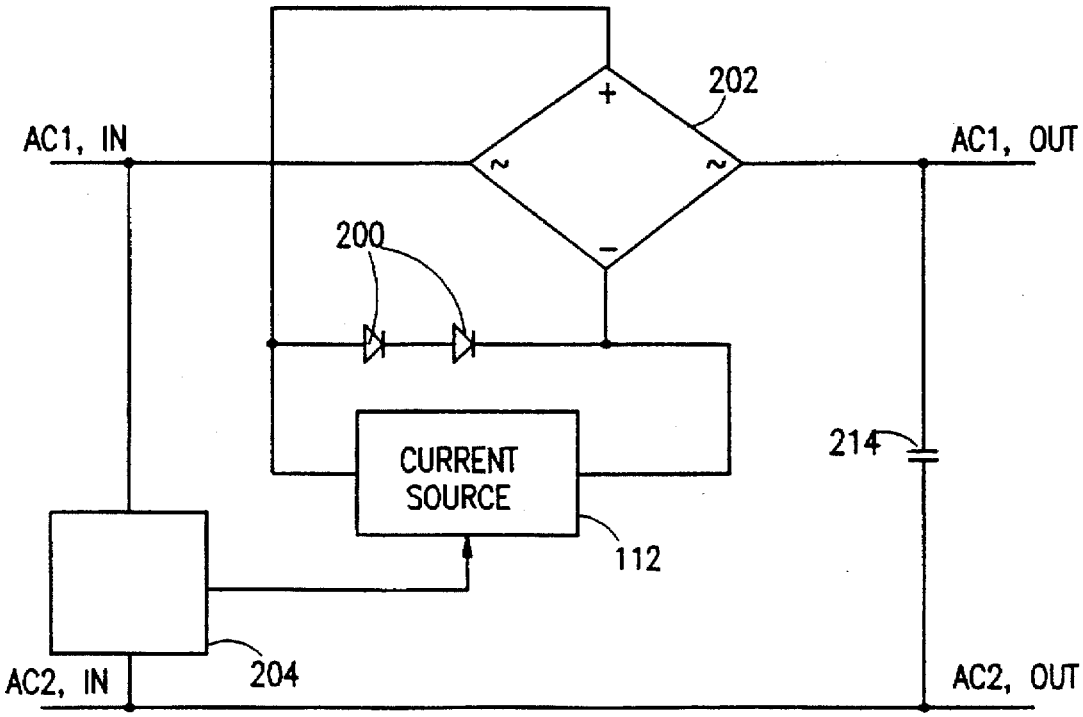
FIG. 11 is simplified block diagram of a modified version of the circuitry of FIG. 10, suitable for AC operation.

Reference is now made to FIG. 11, which illustrates a further modification of the circuitry of FIG. 10. Here a rectifying bridge circuit 202 is associated with the current source 112 and the diodes 200 to enable the current source 112 to be employed with AC current. A bias power supply 204 is provided to create the necessary bias voltage at the current source 112. An AC capacitor 214 corresponds to capacitor 114 in the embodiment of FIG. 2.

Bridge circuit 202 can be any suitable bridge circuit, such as a standard diode bridge or a Shottky bridge or any suitable low voltage drop bridge.

It will be appreciated by persons skilled in the art that the present invention is not limited by what has been particularly shown and described hereinabove. Rather the scope of the present invention is defined only by the claims which follow:

We claim:

1. An active electrical current filter comprising:

an N-channel FET controller coupled in series along a positive electrical line between an electrical power input and an electrical power output having voltages within a given range;

apparatus for providing a driving voltage to the FET controller, said driving voltage being in excess of the voltages within said given range; and a differential voltage sensor, which senses the difference between the voltages at the filter input and output and whose output governs the driving voltage supplied to the FET controller, said active electrical filter exhibiting a voltage drop of less than one volt.

2. An active electrical current filter according to claim 1 wherein said active electrical filter exhibits a voltage drop-out of less than one-half volt.

3. An active electrical filter according to claim 1 and also comprising a current sensor whose output governs the driving voltage supplied to the FET controller.

4. An active electrical filter according to claim 1 and wherein said apparatus for providing a driving voltage comprises a voltage source other than said electrical power input to said FET controller.

5. An active electrical filter according to claim 4 and wherein said voltage source receives electrical power from said electrical power input.

6. An active current filter comprising:

a FET controller coupled in series between an electrical power input and an electrical power output having voltages within a given range;

apparatus for providing a driving voltage to the FET controller, said driving voltage being in excess of the voltages within said given range; and a sensor whose output governs the driving voltage supplied to the FET controller.

7. An active electrical current filter according to claim 1 and also comprising an additional voltage bias operative to provide a desired voltage drop across said FET controller to provide efficient operation of the filter.

8. An active electrical current filter according to claim 2 and also comprising an additional voltage bias operative to provide a desired voltage drop across said FET controller to provide efficient operation of the filter.

9. An active electrical current filter according to claim 3 and also comprising an additional voltage bias operative to provide a desired voltage drop across said FET controller to provide efficient operation of the filter.

10. An active electrical current filter according to claim 4 and also comprising an additional voltage bias operative to provide a desired voltage drop across said FET controller to provide efficient operation of the filter.

11. An active electrical current filter according to claim 5 and also comprising an additional voltage bias operative to provide a desired voltage drop across said FET controller to provide efficient operation of the filter.

12. An active electrical current filter according to claim 6 and also comprising an additional voltage bias operative to provide a desired voltage drop across said FET controller to provide efficient operation of the filter.

13. An active electrical current filter according to claim 7 and also comprising an AC to DC converter upstream of the FET controller.

14. An active electrical current filter according to claim 8 and also comprising an AC to DC converter upstream of the FET controller.

15. An active electrical current filter according to claim 9 and also comprising an AC to DC converter upstream of the FET controller.

16. An active electrical current filter according to claim 10 and also comprising an AC to DC converter upstream of the FET controller.

17. An active electrical current filter according to claim 11 and also comprising an AC to DC converter upstream of the FET controller.

18. An active electrical current filter according to claim 12 and also comprising an AC to DC converter upstream of the FET controller.

19. An active electrical current filter according to claim 7 and also comprising an AC to DC converter upstream of the FET controller and a DC to AC converter downstream of the FET controller.

20. An active electrical current filter according to claim 8 and also comprising an AC to DC converter upstream of the FET controller and a DC to AC converter downstream of the FET controller.

21. An active electrical current filter according to claim 9 and also comprising an AC to DC converter upstream of the FET controller and a DC to AC converter downstream of the FET controller.

22. An active electrical current filter according to claim 10 and also comprising an AC to DC converter upstream of the FET controller and a DC to AC converter downstream of the FET controller.

23. An active electrical current filter according to claim 11 and also comprising an AC to DC converter upstream of the FET controller and a DC to AC converter downstream of the FET controller.

24. An active electrical current filter according to claim 12 and also comprising an AC to DC converter upstream of the FET controller and a DC to AC converter downstream of the FET controller.

25. An active electrical current filter according to claim 1 and also comprising a protection circuit connected in parallel with said FET controller, said protection circuit being operative to limit the voltage across the FET controller and to provide inrush current protection thereto.

26. An active electrical current filter according to claim 2 and also comprising a protection circuit connected in parallel with said FET controller, said protection circuit being operative to limit the voltage across the FET controller and to provide inrush current protection thereto.

27. An active electrical current filter according to claim 6 and also comprising a protection circuit connected in parallel with said FET controller, said protection circuit being operative to limit the voltage across the FET controller and to provide inrush current protection thereto.

28. An active AC electrical current filter comprising:

an AC rectifying bridge arranged in series on an AC line and having positive and negative electrical line outputs carrying voltages within a given range;

an N-channel FET controller coupled in series across said positive and negative electrical line outputs;

apparatus for providing a driving voltage to the FET controller, said driving voltage being in excess of the voltages within said given range; and a differential voltage sensor, which senses the difference between the voltages at the filter input and output and whose output governs the driving voltage supplied to the FET controller.

29. An active electrical current filter according to claim 1 wherein said active electrical filter exhibits a voltage drop-out of less than 100 millivolts.

* * * * *

UNITED STATES PATENT AND TRADEMARK OFFICE

CERTIFICATE OF CORRECTION

PATENT : 5,680,035

DATED : October 21, 1997

INVENTOR(S) : Neerman et al

It is certified that error appears in the above-identified patent and that said Letters Patent is hereby corrected as shown below:

On the title page, under item [19] and item [76], the inventors should read as follows:

--[19] Change " Haim et al" to --Neerman, et al--; and

[76] Inventors: Change "Neerman Haim and Niv Nehemia" to --Haim Neerman and Nehemia Niv--.

Signed and Sealed this

Sixth Day of January, 1998

*Attest:*

Bruce Lehman

BRUCE LEHMAN

*Attesting Officer*

*Commissioner of Patents and Trademarks*